US010127779B2

(12) United States Patent
Auer et al.

(10) Patent No.: US 10,127,779 B2
(45) Date of Patent: Nov. 13, 2018

(54) SIGNALLING DEVICE

(71) Applicant: AUER SIGNAL GMBH, Vienna (AT)

(72) Inventors: Michael Auer, Vienna (AT); Thomas Fehringer, Vienna (AT)

(73) Assignee: AUER SIGNAL GMBH, Vienna (AT)

( * ) Notice: Subject to any disclaimer, the term of this patent is extended or adjusted under 35 U.S.C. 154(b) by 0 days.

(21) Appl. No.: 14/993,549

(22) Filed: Jan. 12, 2016

(65) Prior Publication Data

US 2016/0203686 A1 Jul. 14, 2016

(30) Foreign Application Priority Data

Jan. 12, 2015 (EP) ..... 15150795

(51) Int. Cl.
*G08B 3/00* (2006.01)
*G08B 7/06* (2006.01)
(Continued)

(52) U.S. Cl.
CPC ..... *G08B 7/06* (2013.01); *F21S 8/00* (2013.01); *F21S 10/023* (2013.01); *F21V 23/06* (2013.01);
(Continued)

(58) Field of Classification Search
CPC . G08B 7/06; F21S 8/00; F21S 10/023; F21W 2131/403; F21Y 2101/02
(Continued)

(56) References Cited

U.S. PATENT DOCUMENTS 5,814,968 A * 9/1998 Lovegreen ..... H01M 2/1022 320/113
5,952,915 A * 9/1999 Marquardt ..... F21V 23/06 340/332
(Continued)

FOREIGN PATENT DOCUMENTS

CN 201425200 Y 3/2010
DE 195 13 983 A1 10/1995
(Continued)

OTHER PUBLICATIONS

European Search Report for 15 15 0795 dated Feb. 19, 2015, seven pages.
(Continued)

*Primary Examiner* — Jack K Wang
(74) *Attorney, Agent, or Firm* — Nixon & Vanderhye P.C.

(57) ABSTRACT

A signalling device, in particular for a signalling tower, for purposes of displaying operating states, with at least one signalling module, which has a circuit board element for at least one signalling element for purposes of outputting a signal, in particular for a lighting element for purposes of outputting a signal light, wherein the signalling module can be detachably connected with a further signalling module, and in the connected state the signalling modules are arranged one above another, wherein a connecting conductor, running through the signalling module, is provided for purposes of controlling a circuit board element of the further signalling module, wherein the circuit board element of the signalling module for purposes of forming the connecting conductor has a conducting track assigned to the signalling element of the further signalling module, which conducting track in the connected state of the signalling modules is connected via a contact element with a conducting track; on the circuit board element of the further signalling module, wherein the signalling module has a bayonet coupling
(Continued)

element for purposes of connecting with a bayonet coupling element of the further signalling module, wherein in an interconnected, non-rotated state of the bayonet coupling elements the circuit board elements are arranged in a non-contact position, and in an interconnected, rotated state of the bayonet coupling elements the circuit board are arranged in a contact position with one another.

18 Claims, 9 Drawing Sheets

(51) Int. Cl.

| | |
|---|---|
| ***F21S 8/00*** | (2006.01) |
| ***F21V 23/06*** | (2006.01) |
| ***F21S 10/02*** | (2006.01) |
| *F21W 131/403* | (2006.01) |
| *F21Y 115/10* | (2016.01) |

(52) U.S. Cl.
CPC .... *F21W 2131/403* (2013.01); *F21Y 2115/10* (2016.08)

(58) Field of Classification Search
USPC ..... 340/691.1
See application file for complete search history.

(56) References Cited

U.S. PATENT DOCUMENTS

| | | | | |
|---|---|---|---|---|
| 5,963,126 | A * | 10/1999 | Karlin | B60Q 7/00 340/321 |
| 6,382,811 | B1 | 5/2002 | Bernard | |
| 6,604,838 | B2 * | 8/2003 | Jautz | F21V 23/06 362/219 |
| 7,545,284 | B2 * | 6/2009 | Neumann | F21V 19/001 340/641 |
| 7,587,178 | B2 * | 9/2009 | Marquardt | G08B 7/06 340/5.3 |
| 8,075,408 | B2 * | 12/2011 | Hwang | G07F 17/3202 116/202 |
| 2003/0030567 | A1 * | 2/2003 | Hetzel | G08B 5/38 340/815.4 |
| 2004/0166743 | A1 * | 8/2004 | Kurose | F21V 19/0055 439/701 |
| 2013/0314916 | A1 * | 11/2013 | Clore | F21V 5/04 362/235 |
| 2015/0201261 | A1 | 7/2015 | Feller et al. | |

FOREIGN PATENT DOCUMENTS

| | | | |
|---|---|---|---|
| DE | 198 54 666 | A1 | 6/2000 |
| DE | 100 41 202 | | 3/2002 |
| DE | 60 2005 005 188 | T2 | 12/2009 |
| DE | 10 2011 122 530 | A1 | 4/2013 |
| DE | 20 2013 102 472 | U1 | 8/2013 |
| EP | 1 460 332 | | 9/2004 |
| EP | 1 460 332 | A2 | 9/2004 |
| EP | 1 467 140 | A2 | 10/2004 |
| EP | 1 650 489 | | 4/2006 |
| EP | 1 650 489 | A2 | 4/2006 |
| KR | 10-2014-0014423 | A | 2/2014 |

OTHER PUBLICATIONS

Jun. 11, 2018 Notice from Cancellation Proceedings in German Patent Application No. 20 2015 009 051.6.

* cited by examiner

SIGNALLING DEVICE

This application claims priority to EP Patent Application No. 15150795.1 filed Jan. 12, 2015, the entire content of which is hereby incorporated by reference.

The invention concerns a signalling device, in particular for a signalling tower, for purposes of displaying operating states, with at least one signalling module, which has a circuit board element for at least one signalling element for the output of a signal, in particular for a lighting element for the output of a signal light, wherein the signalling module can be detachably connected with a further signalling module, and in the connected state the signalling modules are arranged one above another, wherein a connecting conductor running through the signalling module is provided for purposes of controlling a circuit board element of the further signalling module.

Such a lighting tower for purposes of displaying operating states, for example of faults on automatically operating machines, is, for example, of known art from DE 195 13 983 A1. The lighting tower has a plurality of signalling elements, essentially the same in their form of construction, and arranged one above another, which are connected with one another by means of a locking connection. The signalling elements consist of a cylindrical section for purposes of accommodating an optical or an acoustic signal generator, and of electrical connecting conductors, which serve to provide individual power supplies to the signalling elements. The electrical connecting conductors are designed as wires, which in each case have at one end an approximately U-shaped connecting bridge, located in an approximately tangentially aligned plane, and at the other end have an angled connecting bar. With the assembly of two adjacent signalling elements the connecting bridge of the one signalling element interacts with the connecting bar of the adjacent lighting element by means of a sprung wire connection in a force fit. By this means electrical contact is made when the individual signalling elements are mechanically connected with one another via a bayonet coupling.

A particular disadvantage in this prior art is that the connecting conductors or feeder lines disturb the light image outputted sometimes by the signalling element. Moreover assembly is intensive in terms of time and cost. In addition, the arrangement of the connecting conductors or feeder lines within the signalling elements entails a high space requirement. As a result the number of signalling elements that can be arranged one above another with a given diameter of the cylindrical accommodation section is limited.

In addition, from EP 1 347 233 A2 a signalling tower with a plurality of segments of different colours has become of known art, in which is provided a circuit board extending through all the segments, which circuit board carries light-emitting diodes as the lighting means. The light-emitting diodes are in each case assigned to one segment, wherein the light-emitting diodes of the various segments can be separately controlled. In this form of embodiment it is, however, disadvantageous that any ability to vary the lighting tower for various applications is lost.

In addition, in the prior art a signalling tower has already been proposed, in which each of the signalling modules has a circuit board. In this form of embodiment the signalling modules are inserted one in another, wherein the circuit boards are connected with one another. However, this form of embodiment is disadvantageous in that the forming of contacts between two circuit boards, and the connection between two signalling modules adjacent to one another, must be undertaken separately.

Accordingly, the task of the present invention consists in creating a signalling device of the generic kind, of the type cited in the introduction, in which the forming of contacts between the individual signalling modules is achieved with means of simple design requiring a low space requirement, wherein the signalling modules can furthermore be disassembled from one another at any point and reassembled again, without the use of tools.

This task is solved by means of a signalling device with the features of claim 1. Preferred forms of embodiment are specified in the dependent claims.

In accordance with the invention the circuit board element of the signalling module has a conducting track assigned to the signalling element of the further signalling module for purposes of forming the connecting conductor; which conducting track in the connected state of the signalling modules is connected via a contact element with a conducting track on the circuit board element of the further signalling module, wherein the signalling module has a bayonet coupling element for purposes of connecting with a bayonet coupling element of the further signalling module, and in an interconnected, non-rotated state of the bayonet coupling elements the circuit board elements are arranged in a non-contact position, and in an interconnected, rotated state of the bayonet coupling elements the circuit board elements are arranged in a contact position with one another.

Advantageously, therefore, the connecting conductors or feeder lines for the supply of the signalling elements via a plurality of signalling modules are integrated into the circuit board elements in the form of conducting tracks. Lighting elements, for example, light-emitting diodes, or acoustic signalling elements, can be provided as signalling elements. By this means connecting conductors or feeder lines e.g. in the form of wires or platelets running outside the circuit board elements can be avoided. In the prior art such connecting conductors or feeder lines have been arranged, spaced apart from one another, running in the axial direction on the inner surfaces of the signalling modules, as result of which—in order to maintain optical interference within an acceptable compass—the number of signalling modules that could be arranged one above another was effectively limited. Moreover, the effort associated with mounting and assembly increased with the number of connecting conductors or feeder lines to be installed. In the inventive signalling device the circuit board element serves not only the purpose of controlling and/or supplying the signalling element located on it, but also for forwarding control and/or supply signals to the signalling elements of signalling modules located above. For this purpose the circuit board element has at least one conducting track that is adopted for the forwarding of electrical control and/or supply signals to a signalling module located above. In addition, each circuit board element has at least one conducting track connected with the signalling element of the said signalling module, in particular in order to adjust the lighting state of the lighting element on the signalling module in question; needless to say, the circuit board element can, however, also have a plurality of signalling elements supplied via various conducting tracks. The effort associated with mounting and assembly is advantageously essentially independent of the number of conducting tracks. In the mechanically connected state of the signalling modules the circuit board elements are connected with one another in an electrically conducting manner via at least two contact elements. At least the lowermost signalling module preferably has a plurality of conducting tracks for purposes of forwarding control and/or supply signals to a plurality of signalling modules located above, wherein a corresponding number of contact elements is provided between the signalling modules. With the assembly of the signalling modules the forming of electrical contacts on the circuit board elements is thus undertaken at the same time. The signalling device can have a base element, preferably at the lower end, to which base element the control and/or supply signals for the individual signalling modules are supplied via connecting means known per se in the prior art. The inventive embodiment brings with it the particular advantage that the number of signalling modules (with a given diameter) that can be arranged one above another, and can individually be assembled or disassembled, can be increased. In addition, the forming of contacts on the circuit board elements when assembling the signalling device can be undertaken more reliably. Furthermore, the inventive configuration is particularly robust. A further advantage of the invention lies in the fact that assembly of the signalling device can be executed more simply and therefore more cost-effectively. Moreover, cost advantages can also be achieved by the form of implementation that saves on parts. Finally, it is advantageous that the light output of the signalling modules to the environment is not impaired by feeder lines.

In addition, the signalling module has a bayonet coupling element for purposes of connecting with a bayonet coupling element of the further signalling module, wherein in an interconnected, non-rotated state of the bayonet coupling elements the circuit board elements are arranged in a non-contact position, and in an interconnected, rotated state of the bayonet coupling elements the circuit board elements are arranged in a contact position with one another. In the prior art, it is of known art per se to connect the signalling modules with one another via bayonet couplings such that they can be detached. For this purpose the signalling modules have cooperating bayonet coupling elements, which are formed by a bayonet projection on the one signalling module, and a bayonet opening on the other signalling module. The bayonet coupling elements can be connected with one another via an insert-and-rotate movement, wherein the bayonet projection is firstly inserted through an entry region of the bayonet opening running in the axial direction, and is subsequently rotated along a securing section of the bayonet opening running essentially at right angles to the entry region.

In the present implementation, the mechanical connection is coupled with the electrical connection between the circuit board elements via the bayonet coupling elements. For this purpose, in the interconnected, non-rotated state of the bayonet coupling elements, the contact elements of the one signalling module are arranged in a non-contact position with respect to the corresponding contact points of the other signalling module. By the arrangement of the bayonet coupling elements in the interconnected, rotated position the contact elements of the one signalling module are brought into contact with the contact points of the other signalling module. In this manner the signalling line between the successive signalling modules can be enabled or interrupted via the bayonet coupling.

In order to be able to apply a control and/or supply voltage to a particular signalling module of the signalling tower, it is favourable if the circuit board element extends essentially over the whole height of the signalling module, wherein in the connected state of the signalling modules the contact element is arranged between an upper face contact point of the one circuit board element and a lower face contact point of the other circuit board element. This form of embodiment is preferably provided in a signalling module with a lighting element. For the purposes of this disclosure the terms "upper" and "lower" relate to an essentially vertical operating position of the signalling device, in which the signalling modules are arranged one above another. In this vertical, i.e. standing, operating position of the signalling device the circuit board element is preferably arranged in an essentially vertical position within the signalling module, wherein the circuit board element in each case extends essentially over the whole height of the related signalling module. In order to forward the electrical control and/or supply signals through a signalling module to a signalling module located above, at least two conducting tracks of the said signalling module are connected, via at least two contact elements, with related conducting tracks of the signalling module located above. Accordingly, the forwarding of signals takes place over essentially the whole height of the signalling device along the conducting tracks of the circuit board elements, wherein the contacts between successive signalling modules are made by means of the contact elements.

In order to be able to make or break the electrical contact between the signalling modules reliably, it is favourable if an elastically deflectable contact spring is provided as the contact element, which contact spring, in the connected state of the signalling modules, connects their circuit board elements with one another. For purposes of forming contacts between the circuit board elements of signalling modules arranged one above another, contact springs are therefore provided, which, when making the mechanical connection between the signalling modules, are applied onto the corresponding contact points of the respective circuit board element. When removing a signalling module from the signalling device the electrical connection via the contact springs is broken at the same time. For purposes of providing reliable contacts through the signalling modules, in the connected state of the signalling modules the contact springs are applied onto the corresponding contact points with a contact pressure.

In order to provide the contacts between the signalling modules in a constructively simple and reliable manner it is advantageous if the circuit board element has stud elements having contact points and projecting from the upper and lower end faces of the circuit board elements, wherein the lower or upper face stud elements are connected with the contact elements, and the upper or lower face stud elements are respectively free of contact elements. Accordingly the contact points of the circuit board element on the one face, preferably on the lower face, are connected with contact elements, and on the other face, preferably on the upper face, are free of such contact elements. When connecting the signalling modules, therefore, the contact elements of the one signalling module are always brought into contact with contact points of the other signalling module that are free of contact elements.

For a robust mounting of the circuit board elements within the signalling modules, it is advantageous if the signalling module has a capping element with a connecting element, which capping element is connected with the circuit board element. The assembly of the signalling device can be undertaken with little effort, if the connecting element is accommodated via a detachable connection, preferably a latching connection, in an outer housing, preferably one with a cylindrical shell surface. In this form of embodiment the connecting element together with the circuit board element is therefore snapped or latched into the outer housing. The outer housing preferably has a cylindrical shell surface, which on the one face is designed with a cover section, or floor section, and on the other face is designed with a retaining opening for purposes of connecting with the further signalling module. At opposite ends of the shell surface, in each case adjacent to the cover/floor section, or the retaining opening respectively, the bayonet coupling elements are preferably provided in the form of the bayonet projections and the bayonet openings respectively.

In one form of embodiment the circuit board element can be arranged essentially completely within a capping element comprising the connecting element. With such a capping element in the form of a housing, the circuit board element, and in particular also the contact elements, are essentially completely protected from mechanical impacts, in particular when connecting the signalling modules.

In order to be able to make and break the electrical and mechanical connections of signalling modules arranged one above another reliably, without the risk of damage, it is favourable, if, for the protection of the contact elements, at least one protective element is provided at least partially enclosing the contact elements. The protective element preferably has a plurality of projections, preferably in the form of pins or studs, which are arranged adjacent to the contact elements.

In particular two rows of such projections are provided here, between which are arranged the contact elements, wherein a first row is provided with comparatively short projections, and a second row is provided with comparatively long projections. The contact points, in particular, stud elements, of a further circuit board element with which contact is to be made, are advantageously arranged when guiding together the signalling modules such that when forming the bayonet coupling they can be rotated over the short projections without coming into contact with the latter.

In contrast the long projections can advantageously be designed such that on the face, on which the contact elements are not provided for purposes of coming into contact with a contact point, they cover the contact elements essentially over the total length, so that access and/or damage to the contact elements is prevented as far as possible.

In order to enable the forming of contacts via the rotational movement when closing the bayonet coupling without unprotected contact points exposed to access, it is favourable if a cover/floor element of the further signalling module or a capping element of a further circuit board element has at least one passage opening curved in the shape of an arc. Contact elements, together with projections of one signalling module providing contact protection as required, can thus in the interconnected, non-rotated state be introduced into passage openings of the other signalling module. When the signalling modules are rotated relative to one another, the contact elements, as well as the (contact protection) projections are then guided into the passage openings in the shape of an arc. With arrival at the stop position, which is preferably defined by the bayonet coupling, the electrical contact between the circuit board elements is made via the contact elements.

In order to improve the optical effect of the light signal transmitted from the signalling element, i.e. in particular in order to achieve a directed radiation of the generated light beams, it is favourable if at least one optical element is connected with the circuit board element, which optical element has at least one optical lens, wherein the number of lenses preferably essentially corresponds to the number of light-emitting diodes provided as the signalling element.

In order to provide protection of the contact elements, a connecting element for an outer housing, and a directed output of the generated light beams, in a constructively simple and cost-effective manner, it is advantageous if at least one capping element is provided, comprising the connecting element, the protective element, and the optical element. By bringing together the three above-cited various functions into a single capping element, both the number of parts and also the assembly effort can be kept low.

The assembly of the signalling device can be configured in a particularly simple manner if the capping element has two half-shells, which are connected with one another via a detachable connection, preferably a latching connection. In the assembled state the circuit board element is therefore arranged between the half-shells of the capping element, wherein, however, the circuit board element can in particular project laterally beyond the assembled half-shells.

For purposes of achieving a signalling tower that can be used in a versatile manner, it is favourable if at least one circuit board element has more than three, preferably at least five, in particular eight, conducting tracks for the control of a corresponding number of signalling modules.

For purposes of achieving a signalling tower it is favourable if at least two signalling modules are provided, connected with one another, and in the connected state arranged one above another. Preferably at least two signalling modules of the same type are provided as light signalling modules with lighting elements. Moreover, a signalling module can be provided with an acoustic signalling element.

In what follows the invention is described in more detail with the aid of preferred examples of embodiment; however, it is not to be limited to the latter. In the figures.

Figure 1:
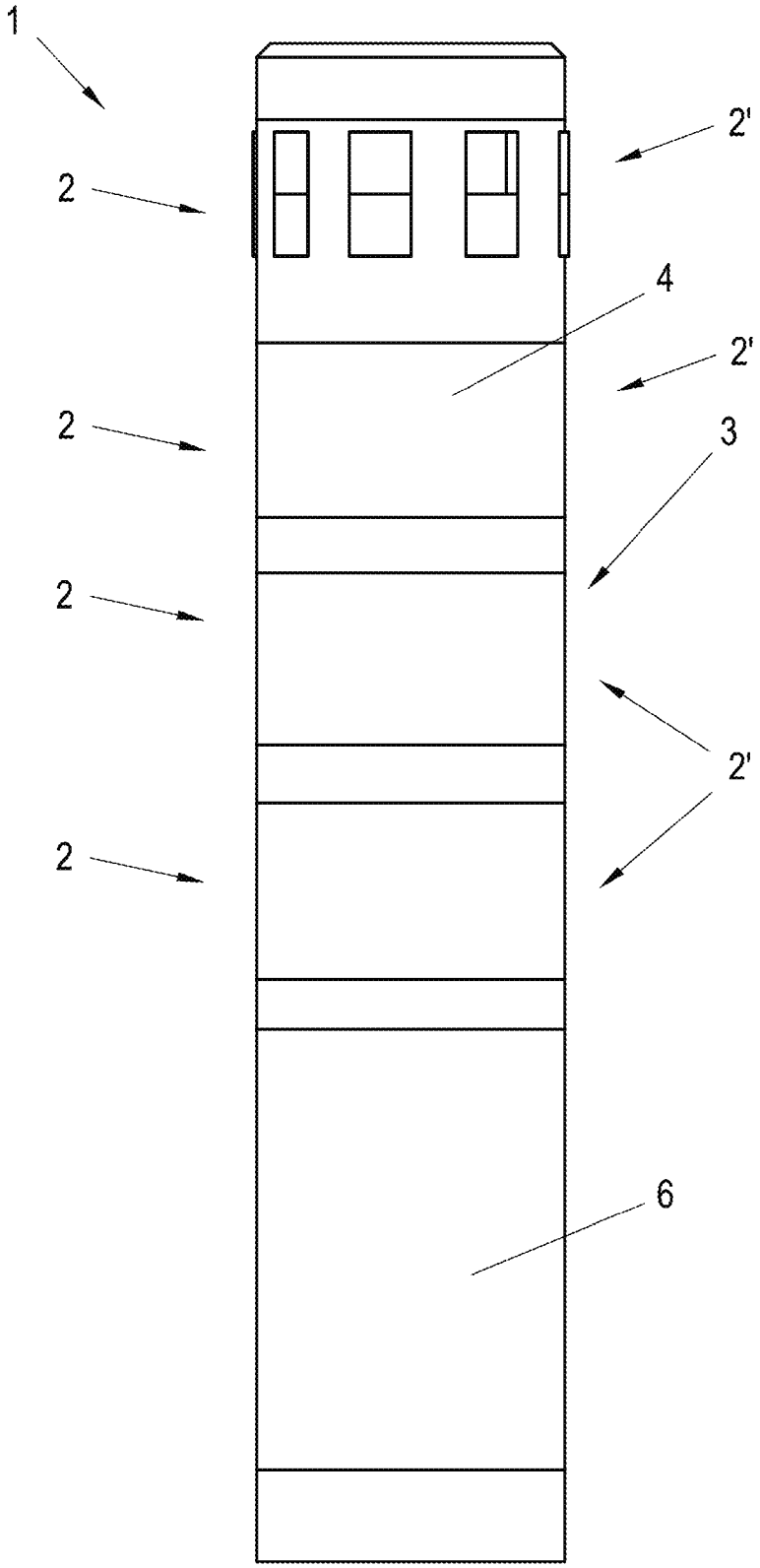
FIG. 1 shows a view of an inventive signalling tower, which has a plurality of signalling modules, detachably connected with one another, for the optical and acoustic display of operating states of a machine.
Figure 4:
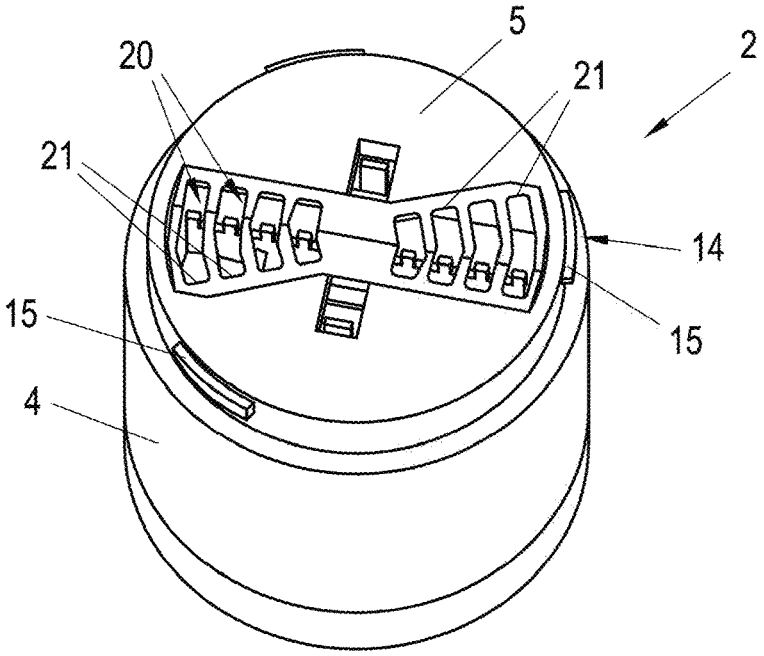
FIGS. 4, 5 show further diagrammatic views of the signalling module as in FIGS. 1 to 3.
Figure 5:
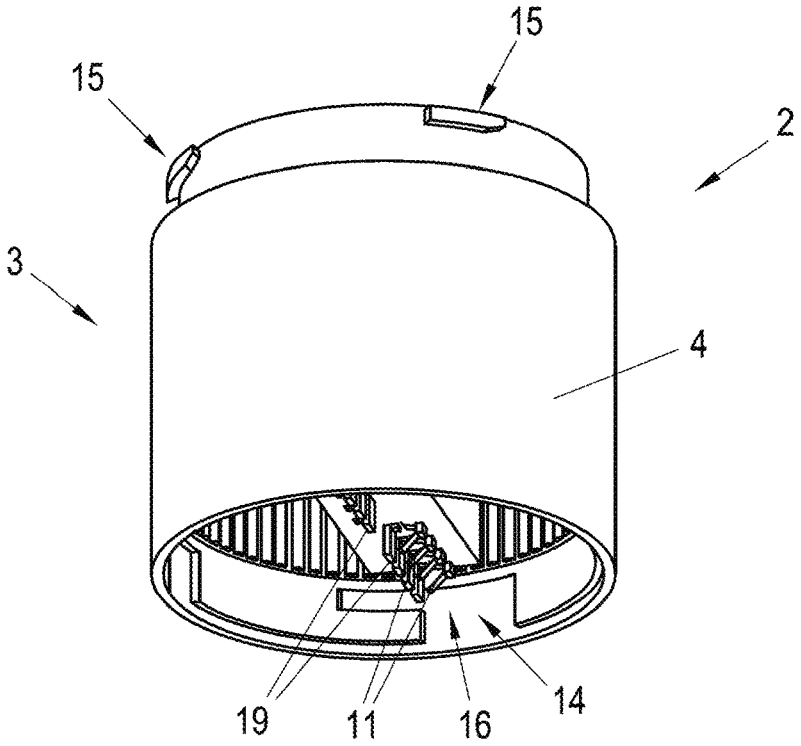

FIG. 1 shows a signalling device 1 for the display of operating states of a machine, or a plant component. The signalling device is designed as a signalling tower with a plurality of signalling modules 2, which, as will be explained in more detail in what follows, can be detachably connected with one another. In the connected state the individual signalling modules 2 are arranged one above another. In the form of embodiment shown three optical signalling modules 2' are provided for the output of lighting signals of different colours, and one acoustic signalling module 2" (sufficiently known in the prior art) is provided for the output of an acoustic signal. The signalling modules 2' have in each case an outer housing 3, which is designed with a cylindrical, partially transparent shell surface 4, in each case embodied in a different colour, and a cover 5 (cf. FIGS. 4, 5). The signalling modules 2 are arranged on a base element 6 in a manner of known art; the latter is connected via electrical connecting means (schematically indicated) with the machine (not shown). Accordingly, the control of all signalling modules 2 is undertaken via the common connecting means of the base element 6.

Figure 2:
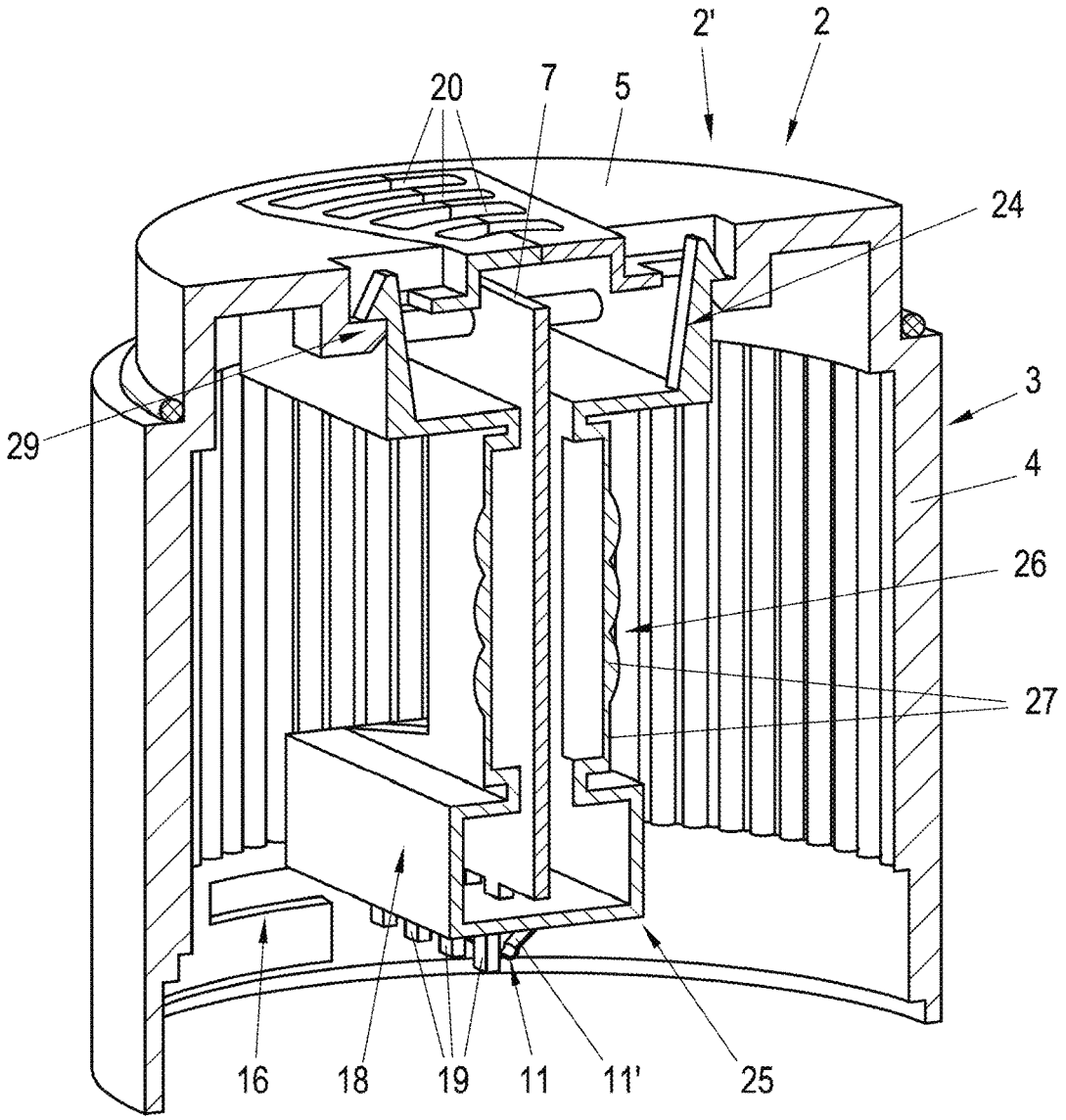
FIG. 2 shows a partially sectioned, diagrammatic view of a signalling module of the signalling tower as in FIG. 1, wherein the signalling module has a circuit board element with an LED lighting element.
Figure 3:
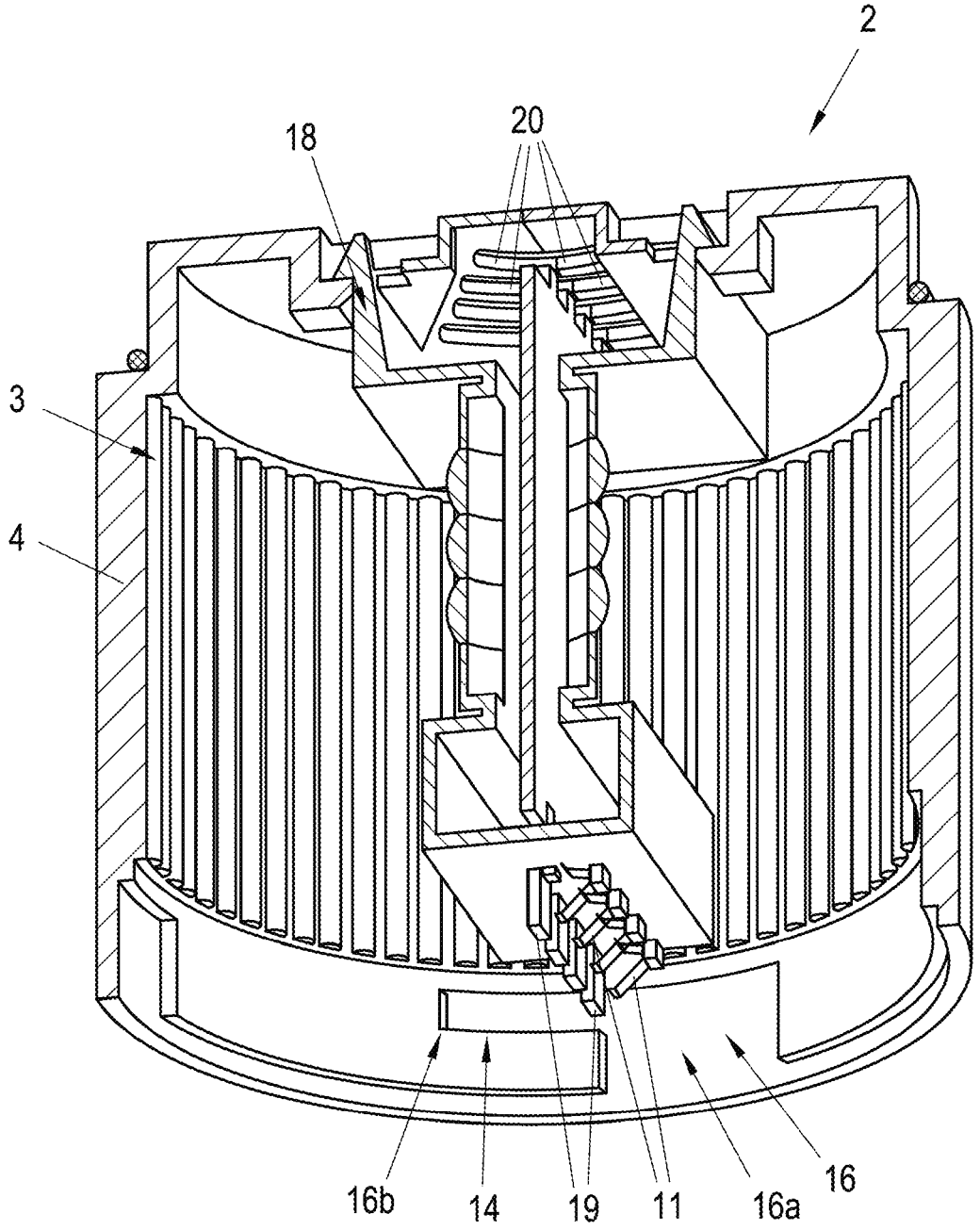
FIG. 3 shows a further partially sectioned diagrammatic view of the signalling module as in FIGS. 1, 2.
Figure 8:
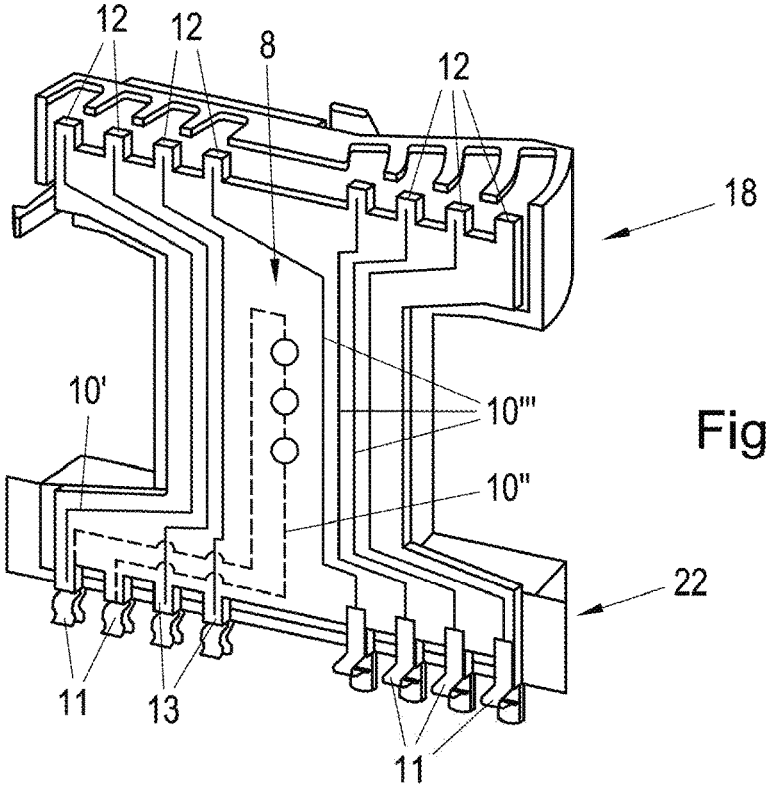
FIG. 8 shows a diagrammatic view of a half-shell of a capping element with an inserted circuit board element.

As can be seen from FIGS. 2, 3, the signalling module 2 has a circuit board element 7 within the outer housing 3, on which circuit board element 7 is arranged, in a manner of known art, at least one signalling element 8 (schematically indicated in FIG. 8) for purposes of outputting a signal. Each of the optical signalling modules 2' has at least one lighting element on the circuit boards 7. At least one light-emitting diode (LED) is provided as the lighting element, wherein the signalling element 8 shown in FIG. 8 comprises a total of six LEDs (three on each face of the circuit board element). For purposes of controlling the circuit board elements 7 connecting conductors are provided, running through the signalling modules 2; which connecting conductors in the visible form of embodiment are integrated into the circuit board elements 7 as conducting tracks 10 shown in FIG. 8 schematically.

Figure 10:
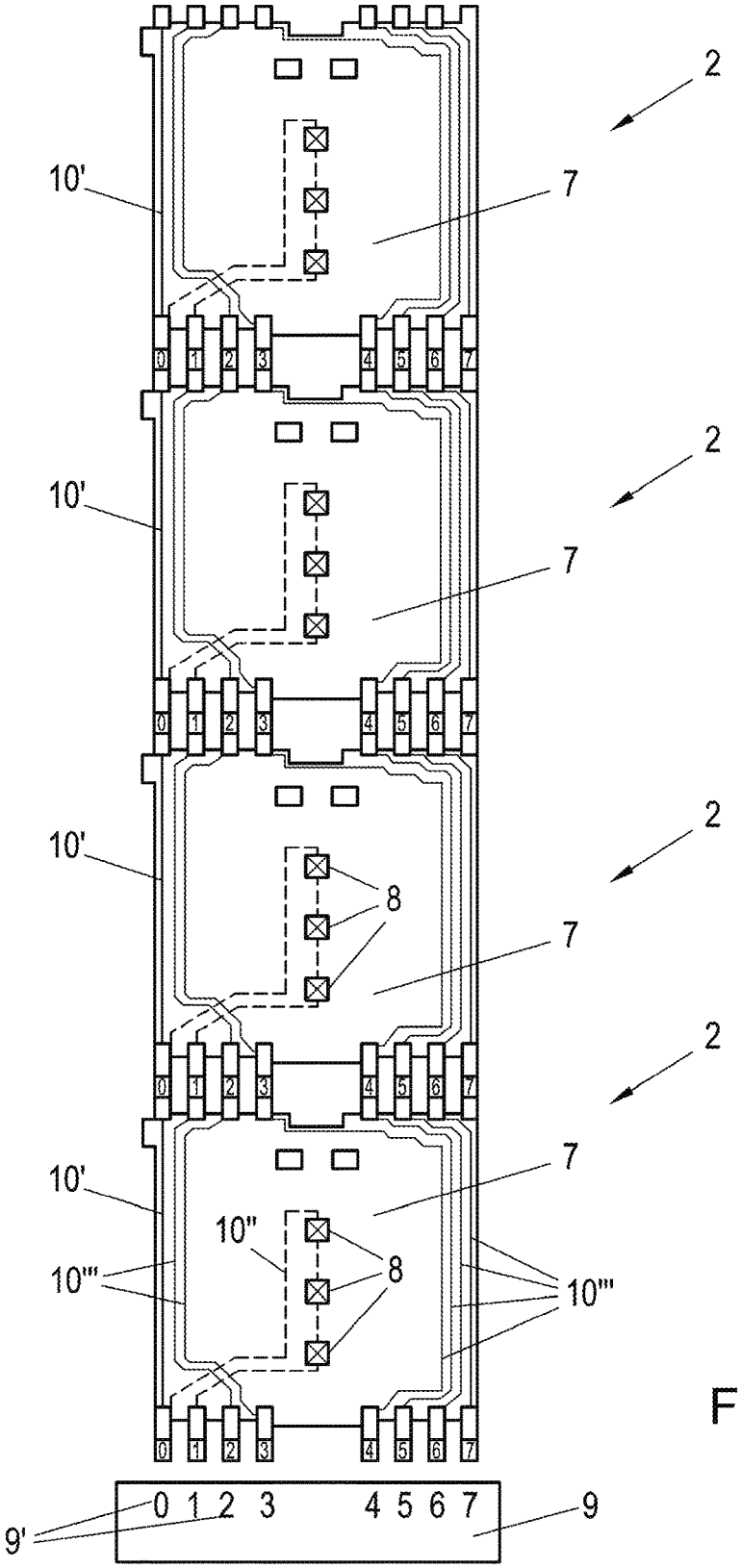
FIG. 10 shows a schematic view of four circuit board elements arranged one above another.

FIG. 10 shows four circuit board elements 7 arranged one above another, together with a base section 9 integrated into the base element 6 with connecting clamps 9' ("0" to "7"). Accordingly, each circuit board element 7 has a "0"-conducting track 10' leading to the next signalling module 2. Furthermore, in each case at least one conducting track 10" is provided, which makes a connection from the contact element "1" to the right of the "0"-conducting track via the respective signalling element 8 to the "0"-conducting track, together with further conducting tracks 10'" passing through the circuit board element. With the application of voltage onto the "0"-conducting track and one of the connecting clamps 9' "1" to "7" a corresponding signalling module 2 can thus be activated. In the mechanically connected state of the signalling modules 2 the conducting tracks 10', 10'" are electrically connected via contact elements 11 with the corresponding conducting tracks 10" on the circuit board element 7 of the signalling module 2 located above. If, therefore, voltage is applied to the connecting clamps 9' "0" and "1", the signalling element 8 of the lowermost signalling module 2 lights up; if voltage is applied to the connecting clamp 9' "0" and "2", the signalling element 8 of the second (as seen from below) signalling module 2 lights up, etc . . . . As can also be seen from FIGS. 2, 3, the circuit board elements 7 extend essentially over the whole height, or axial extent, of the signalling modules 2. In the connected state of the signalling modules 2, the contact elements 11 are arranged between an upper face contact point 12 of the one (lower) circuit board element 7' and a lower face contact point 13 of the other (upper) circuit board element 7" (cf. FIG. 7). Elastically deflectable contact springs 11' are provided as contact elements 11, in the embodiment shown, which contact springs, in the connected state of the signalling modules 2, connect their circuit board elements 7; 7', 7" with one another (cf. FIG. 7).

As can be seen from FIGS. 2 to 5, for purposes of their detachable connection the signalling modules 2 have bayonet coupling elements 14, which are formed by bayonet projections 15 on an upper edge region, displaced inwards, of the shell surface 4 of the outer housing 3, and corresponding bayonet openings 16 on the opposing lower edge region of the shell surface 4 of the outer housing 3. The bayonet coupling elements 14 of signalling modules 2, arranged one above another, can be connected with one another in a manner of known art via an insert-and-rotate form of connection. Here the bayonet projections 15 on the lower signalling module 2 are firstly guided into an entry region **16*a* of the bayonet opening 16 running in the axial direction. The signalling modules 2 are then rotated relative to one another, wherein the bayonet projections 15 are moved along horizontal securing sections 16*b* of the bayonet openings 16. In the interconnected, non-rotated state of the bayonet coupling elements 14 the contact elements 11 of the one (upper) signalling module 2 are arranged at a distance from the corresponding contact points of the other signalling module 2. By arrangement of the bayonet coupling elements 14 in the interconnected, rotated position as in FIG. 1, the contact points 12, 13 of signalling modules 2, arranged one above another, are brought into conducting contact. In this manner the signalling line between the successive signalling modules 2** can be enabled or interrupted via the bayonet connection.

Figure 6:
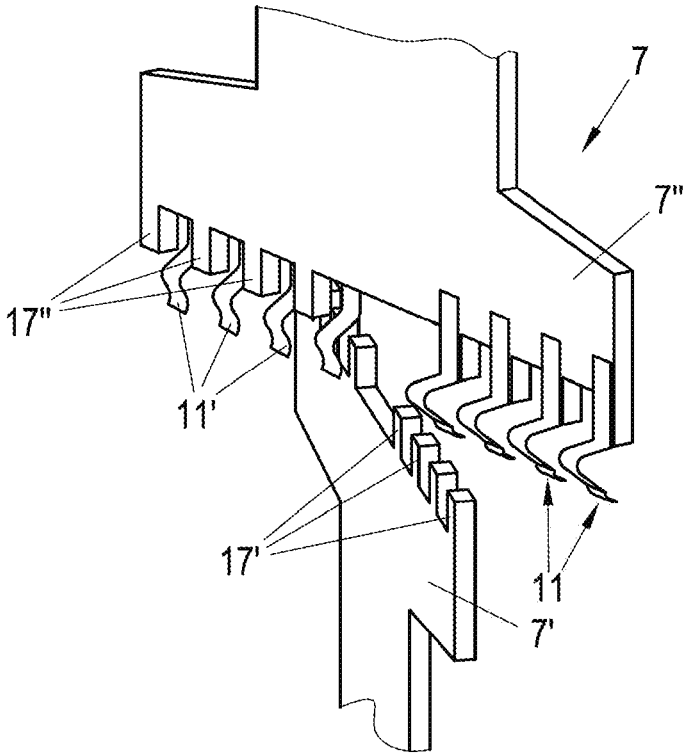
FIGS. 6 and 7 show schematic views of the circuit board elements of signalling modules arranged one above another, the conducting tracks of which can be connected with each other via contact springs, by rotation between the inoperative position represented in FIG. 6 and the contact position represented in FIG. 7.
Figure 7:
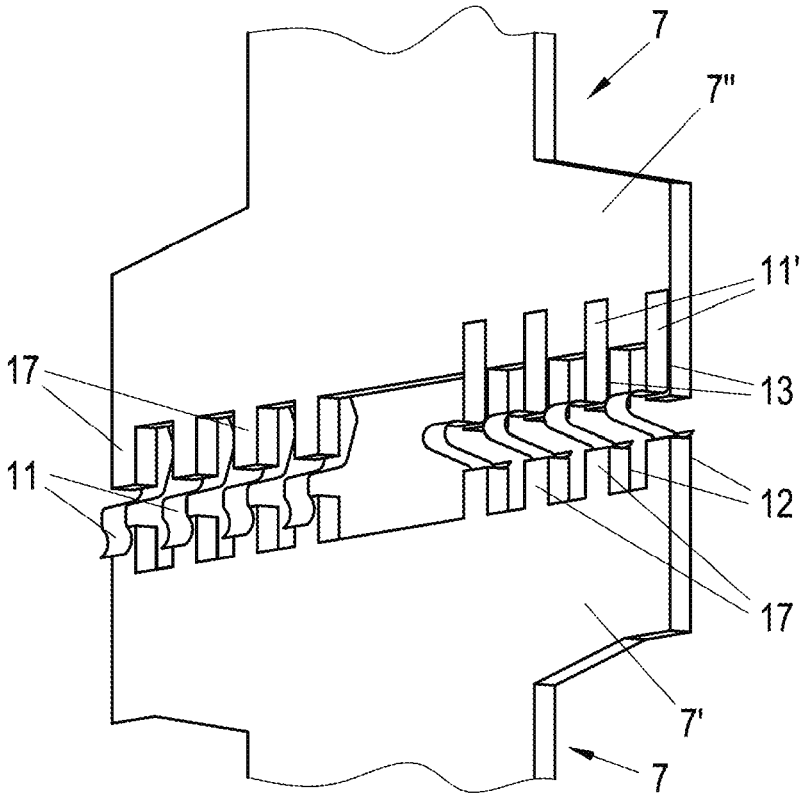

As can be seen in particular from FIGS. 6, 7, the circuit board elements 7 have stud elements 17 forming the contact points 12, 13; which stud elements 17 project upwards from the upper end faces of the circuit board elements 7, and downwards from the lower end faces of the circuit board elements 7. In the form of embodiment shown, the lower face stud elements 17" are in each case connected with the contact elements 11, whereas the upper face stud elements 17' are free of such contact elements 11.

As can be seen from FIG. 8, 9, cf. also FIGS. 2, 3, each of the signalling modules 2 has a capping element 18 for the related circuit board element 7, wherein in a first example of embodiment the related circuit board element 7 is accommodated essentially completely within the capping element 18. In a lower section the capping element 18 has a protective element 25, with two rows of projections 19, wherein one row is provided with longer projections 19', and one row with shorter projections 19". The contact elements 11 are in each case arranged between the projections 19', 19" serving to provide contact protection. The longer projections 19' cover, essentially completely, the contact elements 11 on that face on which no contacts are made. The shorter projections 19", in contrast, leave an end section of the contact elements 11 free for purposes of forming contacts. When guiding together two signalling modules 2, the contact elements 11, as well as the projections 19', 19", are accommodated in corresponding passage openings 20 on the upper face of the capping element 18 of the adjacent signalling module 2. For purposes of matching the rotational movement during the closure of the bayonet coupling the passage openings 20 of the capping element 18 are curved in the shape of an arc. When rotating the signalling modules 2 so as to make the bayonet coupling, the pin-shaped projections 19 of the one (upper) signalling module 2 are therefore moved into the passage openings 20 curved in the shape of an arc of the other (lower) signalling module 2. The same procedure occurs for the respective number of signalling modules 2.

The arrangement of the longer 19' and shorter projections 19" is reversed on the opposing radial sections of the capping element 18. Thus, with the arrival at a stop position defined by the bayonet coupling, contact is reliably made between adjacent circuit board elements 7. Here the configuration of the shorter projections 19" at the same time ensures that the contacts between the circuit board elements 7 are not impaired when the signalling modules 2 are connected.

Figure 9:
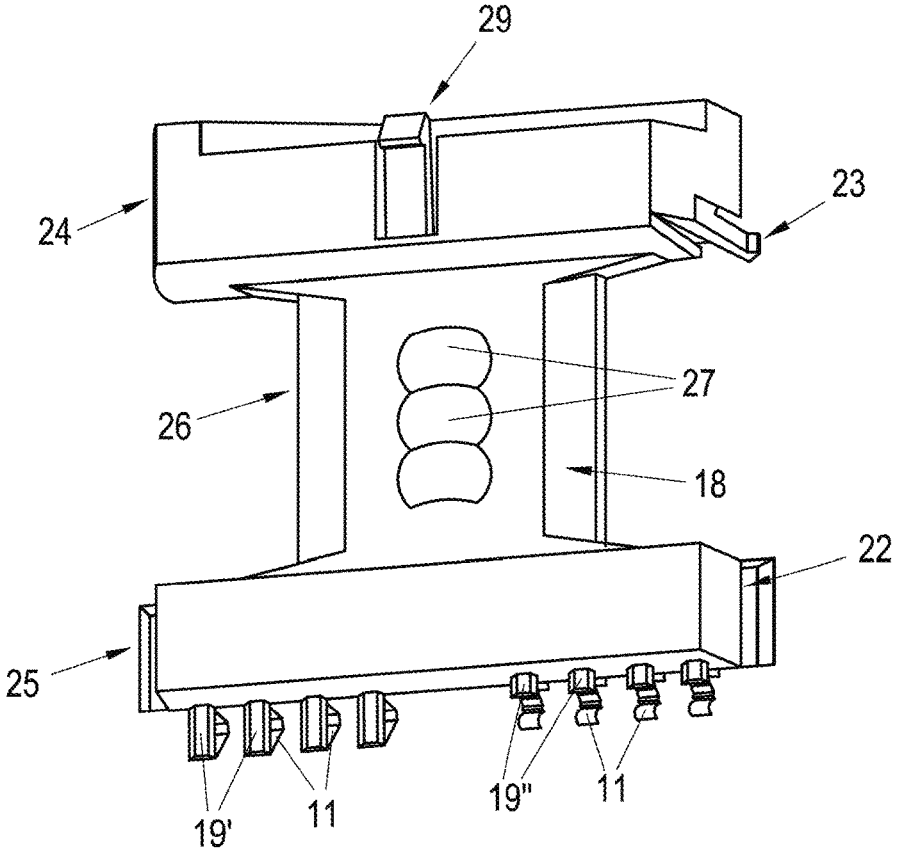
FIG. 9 shows a further diagrammatic view of the half-shell of the capping element for the circuit board element.

As can also be seen from FIGS. 8, 9, cf. also FIGS. 2, 3, the capping element 18 has two half-shells 22, which are connected with one another via a latching connection 23. In the connected state of the half-shells 22 the capping element 18 has a connecting element 24, in which the passage openings 20 are provided, a protective element 25 with projections 19', 19", and an optical element 26. The optical element 26 has a number of lenses 27, with which the light beams, outputted from the respective LED of the signalling element 8 in each case, are distributed and directed in an appropriate manner. The capping element 18 is itself mounted via a snap connection 29 in the outer housing 3.

Figure 11:
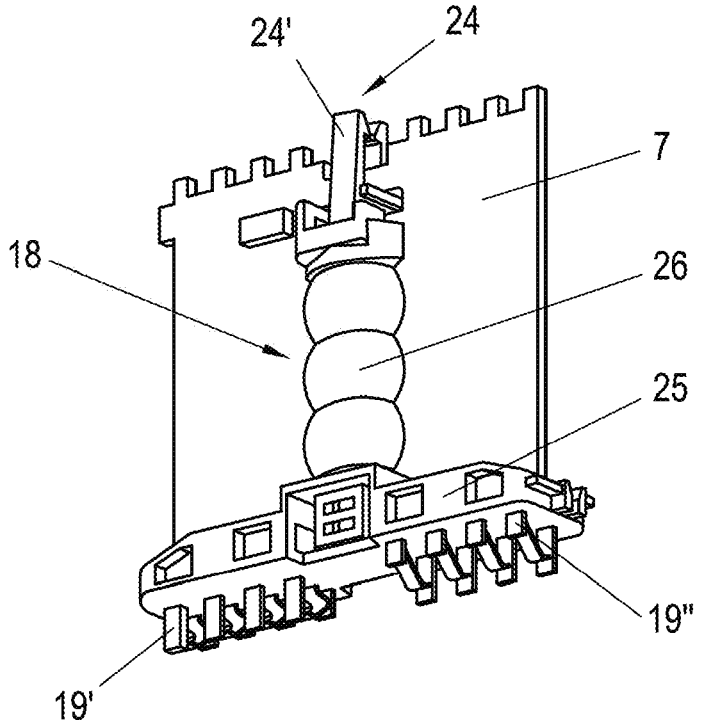
FIG. 11 shows a diagrammatic view of a second example of embodiment of an inventive circuit board element with a capping element.
Figure 12:
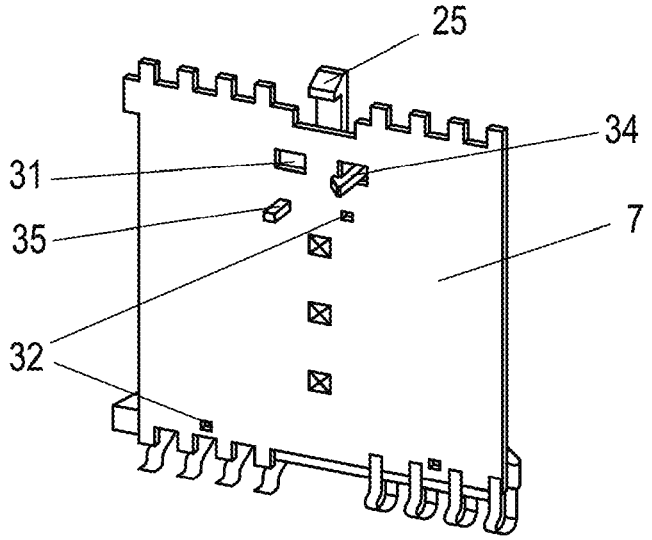
FIG. 12 shows a diagrammatic view of the example of embodiment as in FIG. 11 with a half-shell of the capping element removed.
Figure 13:
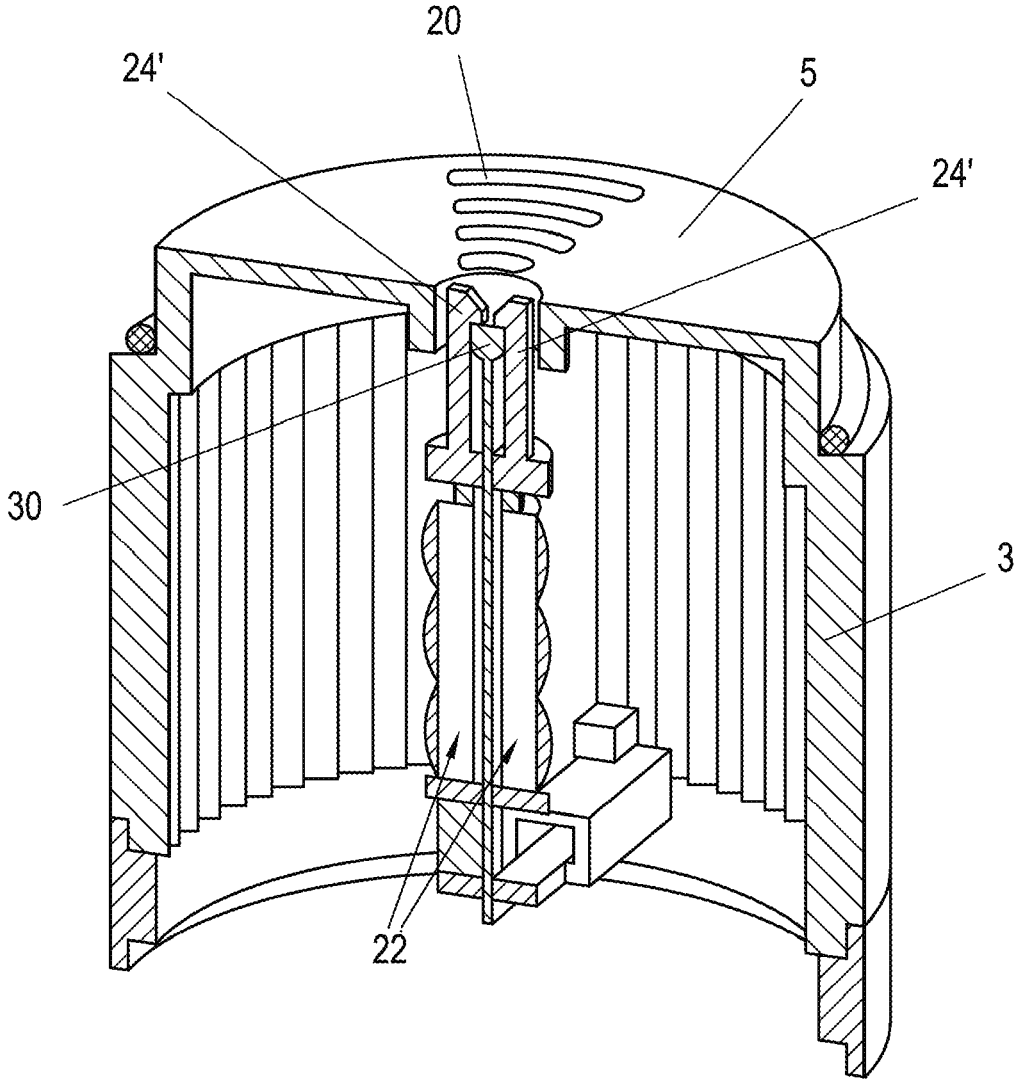
FIG. 13 shows a sectioned diagrammatic view of a second example of embodiment of an inventive signalling module.

In FIGS. 11 to 13, a further example of embodiment can be seen, in which the capping element 18 is significantly reduced compared with that in the first example of embodiment. That is to say, this capping element 18 does not enclose the circuit board element 7, in the form of a protective housing; instead, a circuit board element 7 with an essentially constant width is provided, which extends significantly beyond the capping element 18, in particular in the region of the optical element 26 and the connecting element 24. As a matter of fact, the capping element 18 as described in connection with the first example of embodiment, has a connecting element 24 with latching projections 24' for purposes of attachment onto the housing 3, or onto a cover 5 that is separately formed from, or integrally formed with, the housing 3.

In the second example of embodiment, as in FIGS. 11 to 13, the passage openings 20, moreover, are also formed in the cover 5 and not in the capping element 18.

The circuit board element 7, which is securely connected with the capping element 18, can thus be connected in the housing 3 in a simple manner by means of a snap connection, via the latching catches 24', in particular with a central bar 30 of the cover 5.

However, in the capping element 18 of the second example of embodiment the protective element 25, in particular for purposes of protecting contact elements 11 surrounds as before a lower end section of the circuit board element 7, wherein—as described already in detail in connection with the first example of embodiment—the contact elements 11 are accommodated between a row of short projections 19" and long projections 19' of the protective element 25.

In FIGS. 12 and 13 it can, in particular, be seen that also the capping element 18 in accordance with the second example of embodiment is essentially composed of two half-shells 22, wherein for purposes of a simple design of connection between the two half-shells 22 of the capping element 18 and the circuit board element 7, the circuit board element 7 has openings 31, 32, through which connecting elements of the respective half-shell, in particular latching hooks 34 or connecting pins 35 can be fed through for purposes of making a plug-in connection with the opposing half-shell of the capping element 18. What is essential in both examples of embodiment, however, is simply the fact that in the connection of two signalling modules 2 via a bayonet coupling in the rotated state, an electrical connection is made at the same time between circuit board elements arranged one above another.

The invention claimed is:

1. A signalling device, in particular for a signalling tower, for purposes of displaying operating states, with at least one signalling module, which has a circuit board element for at least one signalling element for purposes of outputting a signal, in particular for a lighting element for purposes of outputting a signal light, wherein the signalling module can be detachably connected with a further signalling module, and the signalling modules in the connected state are arranged one above another, wherein a connecting conductor running through the signalling module is provided for purposes of controlling a circuit board element of the further signalling module, wherein the signalling module has a bayonet coupling element for purposes of connecting with a bayonet coupling element of the further signalling module, wherein in an interconnected, non-rotated state of the bayonet coupling elements the circuit board elements are arranged in a non-contact position, and in an interconnected, rotated state of the bayonet coupling elements the circuit board elements are arranged in a contact position with one another, wherein the circuit board element extends essentially over the whole height of the signalling module and the circuit board element of the signalling module for purposes of forming the connecting conductor has a conducting track assigned to the signalling element of the further signalling module, which conducting track in the connected state of the signalling modules is connected via a contact element with a conducting track on the circuit board element of the further signalling module, wherein in the connected state of the signalling modules the contact element is arranged between an upper face contact point of the one circuit board element and a lower face contact point of the other circuit board element, wherein the circuit board element had stud elements, having contact points and projecting from the upper and lower end faces of the circuit board elements, wherein the lower or upper face stud elements are connected with the contact elements, and the upper or lower face stud elements are respectively free of contact elements.

2. The signalling device in accordance with claim 1, wherein an elastically deflectable contact spring is provided as the contact element, which contact spring in the connected state of the signalling modules connects their circuit board elements with one another.

3. The signalling device in accordance with claim 1, wherein the signalling module has a capping element with a connecting element, the capping element being connected with the circuit board element, wherein the connecting element is accommodated via a detachable connection, in an outer housing.

4. The signalling device in accordance with claim 1, wherein for purposes of protecting the contact elements at least one protective element is provided, at least partially enclosing the contact elements.

5. The signalling device in accordance with claim 4, wherein the protective element has two rows of projections, between which the contact elements are arranged, wherein a first row has comparatively short projections and a second row has comparatively long projections.

6. The signalling device in accordance with claim 3, wherein a cover/floor element of the further signalling module or the capping element of a further circuit board element has at least one passage opening curved in the shape of an arc.

7. The signalling device in accordance with claim 1, wherein at least one optical element is connected with the circuit board element, which optical element has at least one optical lens.

8. The signalling device in accordance with claim 1, wherein at least one capping element is provided, comprising the connecting element, the protective element and the optical element.

9. The signalling device in accordance with claim 3, wherein the capping element has two half-shells, which are connected with one another via a detachable connection.

10. The signalling device in accordance with claim 1, wherein at least one circuit board element has more than three conducting tracks for the control of a corresponding number of signalling modules.

11. The signalling device in accordance with claim 1, wherein at least two signalling modules are provided, connected with one another, and in the connected state arranged one above another.

12. The signalling device in accordance with claim 3, wherein the detachable connection is a snap connection.

13. The signalling device in accordance with claim 3, wherein the outer housing has a cylindrical shell surface.

14. The signalling device in accordance with claim 3, wherein the detachable connection is a snap connection, and wherein the outer housing has a cylindrical shell surface.

15. The signalling device in accordance with claim 7, wherein the number of lenses corresponds essentially to a number of light-emitting diodes provided as a signalling element.

16. The signalling device in accordance with claim 9, wherein the detachable connection is a latching connection.

17. The signalling device in accordance with claim 1, wherein at least one circuit board element has at least five conducting tracks for the control of a corresponding number of signalling modules.

18. The signalling device in accordance with claim 1, wherein at least one circuit board element has eight conducting tracks for the control of a corresponding number of signalling modules.

* * * * *